US011910900B2

(12) United States Patent
Fazackerley et al.

(10) Patent No.: US 11,910,900 B2
(45) **Date of Patent: *Feb. 27, 2024**

(54) CONTAINMENT MAT THAT CONVERTS TO LUGGAGE WITH SECURE SEAL

(71) Applicants: Amy S. Fazackerley, Alexandria, VA (US); Adam D. Fazackerley, Alexandria, VA (US)

(72) Inventors: Amy S. Fazackerley, Alexandria, VA (US); Adam D. Fazackerley, Alexandria, VA (US)

( * ) Notice: Subject to any disclaimer, the term of this patent is extended or adjusted under 35 U.S.C. 154(b) by 70 days.

This patent is subject to a terminal disclaimer.

(21) Appl. No.: 17/385,072

(22) Filed: Jul. 26, 2021

(65) Prior Publication Data

US 2021/0353018 A1 Nov. 18, 2021

Related U.S. Application Data

(63) Continuation of application No. 16/792,837, filed on Feb. 17, 2020, now Pat. No. 11,116,298, which is a continuation of application No. 16/029,341, filed on Jul. 6, 2018, now Pat. No. 10,561,213, which is a continuation of application No. 14/797,396, filed on Jul. 13, 2015, now Pat. No. 10,016,036, which is a continuation of application No. 13/137,762, filed on Sep. 12, 2011, now Pat. No. 9,084,459.

(Continued)

(51) Int. Cl.

| | |
|---|---|
| ***A45C 9/00*** | (2006.01) |
| ***A45C 13/10*** | (2006.01) |
| *A45C 3/00* | (2006.01) |

(52) U.S. Cl.

CPC ..... *A45C 9/00* (2013.01); *A45C 13/1046* (2013.01); *A45C 3/00* (2013.01)

(58) Field of Classification Search

CPC ..... A45C 9/00; A45C 3/00; A45C 13/1046
USPC ..... 383/4
See application file for complete search history.

(56) References Cited

U.S. PATENT DOCUMENTS 835,673 A 11/1906 Fross
977,129 A 11/1910 Bruce
(Continued)

FOREIGN PATENT DOCUMENTS

AU 2010100792 A4 8/2010

OTHER PUBLICATIONS

Swoop, LLC, http://swoopbags.com/ @ 2010-2011, (accessed Sep. 9, 2011), 1 page.

(Continued)

*Primary Examiner* — Peter N Helvey
(74) *Attorney, Agent, or Firm* — MH2 TECHNOLOGY LAW GROUP, LLP

(57) ABSTRACT

A convertible containment device includes a flexible base portion configured to substantially conform to a supporting surface when the device is in an open configuration, a wall affixed to a perimeter of the flexible base and extending away from the flexible base when the device is in the open configuration, and a cinch cord in operable relation with the wall, and forming a loop when the device is in the open configuration. The cinch cord is configured such that pulling the cinch cord causes the device to transform from the open configuration to a bag-like configuration by gathering the wall to form an annulus having an opening, and the opening of the annulus is sized to prohibit exit of an object from within the bag-like configuration.

21 Claims, 10 Drawing Sheets

Related U.S. Application Data

(60) Provisional application No. 61/344,922, filed on Nov. 18, 2010.

(56) References Cited

U.S. PATENT DOCUMENTS

| | | | |
|---|---|---|---|
| 1,629,723 | A | 5/1927 | Moler |
| 1,681,922 | A | 8/1928 | Boch |
| 1,688,288 | A | 10/1928 | Gerald |
| 2,479,203 | A | 8/1949 | Brown |
| 2,781,811 | A | 2/1957 | Georgia |
| 2,897,863 | A | 8/1959 | Somers, Jr. |
| 3,475,767 | A | 11/1969 | Friesen |
| 3,838,758 | A | 10/1974 | Brown |
| 4,337,812 | A | 7/1982 | Trinkner |
| D277,429 | S | 2/1985 | LeBoutillier |
| D291,133 | S | 7/1987 | Disanza |
| 4,738,545 | A | 4/1988 | Westgor |
| 4,794,029 | A | 12/1988 | Tennant et al. |
| D299,979 | S | 2/1989 | Garrison |
| 4,856,912 | A | 8/1989 | Damus et al. |
| 4,938,607 | A | 7/1990 | Kelley |
| 4,955,068 | A | 9/1990 | Tennihan |
| 4,991,978 | A | 2/1991 | Ostrowski |
| 5,069,554 | A | 12/1991 | Bonnett |
| 5,092,681 | A | 3/1992 | Ashley, III |
| 5,187,823 | A | 2/1993 | Ferguson et al. |
| 5,195,828 | A | 3/1993 | Bush-Rodriquez |
| 5,207,508 | A | 5/1993 | Koutsis, Jr. |
| D341,934 | S | 12/1993 | Abraham |
| RE34,849 | E | 2/1995 | Sanders |
| 5,417,462 | A | 5/1995 | Hensley |
| 5,419,564 | A | 5/1995 | Lamle |
| 5,435,024 | A | 7/1995 | Capshaw |
| 5,450,629 | A | 9/1995 | Gilstrap |
| 5,482,374 | A | 1/1996 | Buhyoff |
| 5,529,395 | A | 6/1996 | French |
| 5,693,398 | A | 12/1997 | Granger |
| 5,819,343 | A | 10/1998 | Zampirri, Jr. et al. |
| 5,895,118 | A | 4/1999 | Hensley |
| 5,899,571 | A | 5/1999 | Chalk |
| 5,971,611 | A | 10/1999 | Rosengren |
| D421,178 | S | 2/2000 | Dandini |
| D421,521 | S | 3/2000 | Howard |
| 6,176,356 | B1 | 1/2001 | Powley |
| 6,485,344 | B2 | 11/2002 | Arias |
| D482,224 | S | 11/2003 | DeCet |
| D523,636 | S | 6/2006 | Wilmink |
| 7,263,732 | B2 | 9/2007 | Zheng |
| 7,360,664 | B1 | 4/2008 | Ransom |
| 7,490,378 | B2 | 2/2009 | Le Gette et al. |
| 7,624,777 | B2 | 12/2009 | Paller |
| 9,084,459 | B2 | 7/2015 | Fazackerley et al. |
| 10,016,036 | B2 | 7/2018 | Fazackerley et al. |
| 10,561,213 | B2 | 2/2020 | Fazackerley et al. |
| 2006/0008182 | A1 | 1/2006 | Ingraselino |
| 2008/0173680 | A1 | 7/2008 | Gilham Callahan |
| 2010/0104222 | A1 | 4/2010 | Dodd |
| 2011/0042428 | A1 | 2/2011 | Ranciato |
| 2011/0280500 | A1 | 11/2011 | Nelson |
| 2012/0243806 | A1 | 9/2012 | Parks |
| 2015/0313335 | A1 | 11/2015 | Fazackerley et al. |
| 2018/0310680 | A1 | 11/2018 | Fazackerley et al. |
| 2020/0196722 | A1 | 6/2020 | Fazackerley et al. |

OTHER PUBLICATIONS

Swoop, LLC, http://swoopbags.com/shop/ @ 2010-2011, (accessed Sep. 9, 2011), 1 page.

Swell Stuff, http://www.swell-stuff.com/cinch_sac.html (date unknown) (accessed Sep. 9, 2011), 1 page.

Gogo&Co, http://www.gogoandco.com/cart/, @ 2010, (accesed Sep. 9, 2011), 1 page.

Toysperiod, http://www.toysperiod.com/lego-set-reference/universal-building-set/supplemental/lego-787-play-mat-with-drawstring/ @ 2011, (accessed Sep. 9, 2011), 2 pages.

Amazon.com, Inc., http://www.amazon.com/Mattel-J1810-Matchbox-Sto-Playmat/dp/B000ETPO9Y/ref=pd_rhf_p_t_1 @ 1996-2011, (accessed Sep. 9, 2011), 5 pages.

Ex. William Krynski, International Search Report and the Written Opinion of the International Searching Authority dated Mar. 26, 2013, for Intl Appl. No. PCT/US11/01879 filed Nov. 15, 2011 (corresponding PCT application), pp. 1-9.

Helvey, Peter N., Non-Final Office Action issued in corresponding U.S. Appl. No. 13/137,762 dated Jan. 30, 2013, 13 pages.

Helvey, Peter N., Final Office Action issued in corresponding U.S. Appl. No. 13/137,762 dated Aug. 20, 2013, 18 pages.

Helvey, Peter N., Non-Final Office Action issued in corresponding U.S. Appl. No. 13/137,762 dated Aug. 20, 2014, 14 pages.

Helvey, Peter N., Non-Final Office Action issued in corresponding U.S. Appl. No. 13/137,762 dated Apr. 13, 2015, 10 pages.

Helvey, Peter N., Notice of Allowance issued in corresponding U.S. Appl. No. 13/137,762 dated Jun. 8, 2015, 15 pages.

Helvey, Peter N., Non-Final Office Action issued in corresponding U.S. Appl. No. 14/797,396 dated Dec. 1, 2017, 25 pages.

Helvey, Peter N., Notice of Allowance issued in corresponding U.S. Appl. No. 14/797,396 dated May 23, 2018, 13 pages.

Helvey, Peter N., Non-Final Office Action issued in corresponding U.S. Appl. No. 16/029,341 dated May 17, 2019, 15 pages.

Helvey, Peter N., Notice of Allowance issued in corresponding U.S. Appl. No. 16/029,341 dated Oct. 30, 2019, 13 pages.

Helvey, Peter N., Non-Final Office Action issued in corresponding U.S. Appl. No. 16/792,837 dated Nov. 19, 2020, 15 pages.

CONTAINMENT MAT THAT CONVERTS TO LUGGAGE WITH SECURE SEAL

CROSS-REFERENCE TO RELATED APPLICATIONS

This application is a continuation of, and claims priority of U.S. application Ser. No. 16/792,837 filed 17 Feb. 2020 (currently allowed), which is a continuation of U.S. application Ser. No. 16/029,341 filed 6 Jul. 2018 (issued as U.S. Pat. No. 10,561,231), which is a continuation of U.S. application Ser. No. 14/797,396 filed on 13 Jul. 2015 (issued as U.S. Pat. No. 10,016,036), which is a continuation of U.S. application Ser. No. 13/137,762 filed on 12 Sep. 2011 (issued as U.S. Pat. No. 9,084,459), which claims the benefit of U.S. Provisional Application No. 61/344,922, filed 18 Nov. 2010, all of which are hereby incorporated by reference in their entireties.

FIELD OF THE INVENTION

The present invention relates to convertible luggage, and more particularly, to a mat that contains items and converts to a transportable container having a nearly completely closable opening.

BACKGROUND

Projects and activities involving multiple items, such as play/toy pieces, small parts, components, collections, balls, supplies, and the like, are difficult and time-consuming to clean up after. It is difficult to pick up large numbers of small items from a work or play surface and place them in a storage container. It also takes a long time, especially when the items have been scattered over a sizable area during use.

In the case of play/toy pieces, manufacturers or parents typically provide rigid or soft/flexible containers for storage of items when not in use on a play or work surface. Examples of typical rigid containers include large plastic containers, lunch boxes, picnic baskets, bins, baskets, and/or drawers. Examples of typical soft/flexible containers include backpacks, sacks, Zip-Lock™ brand storage bags, and pillow cases.

Such conventional containers have several drawbacks. For example, rigid containers are difficult to carry and stow because their rigidness does not allow them to conform to a person that is carrying them or to an available storage space. In addition, when more than a few small play/toy pieces are placed in a rigid container, the pieces stack up on one another, and the users, such as children, are neither able to see nor get to the pieces that shift to the center or bottom of these containers. This makes it difficult to play with, or even see, all of the pieces of, for example, a play set.

Another drawback of rigid containers is that they are inconvenient to transport to another location, especially when they contain a heavy quantity of items. For example, a rigid container cannot be comfortably slung on one's back and walked with, for example, to a neighbor's house or down the aisle of an airliner. In addition, rigid containers are typically breakable, and a broken container may release small items held inside. For example, if a rigid plastic container containing small building block toys is dropped on a hard floor in an airport, or on a driveway at a neighbor's house, it may crack open, scattering the building block toys that were held inside.

Typical flexible containers, such as tote bags and sacks, do not securely contain small items, such as play pieces or work items that are only a few millimeters in size, because they are designed to stop the passage of large items, such as books and clothing, and because they do not securely and completely close their openings. Lacking means for completely and securely closing all openings, tote bags and sacks do not prevent small pieces from falling out when dropped, flipped, or shaken, as might occur during transport by person or car, or as airline baggage. And, like rigid containers, the sack-like or bag-like shape of a flexible container causes pieces to stack up on one another, such that a user of the pieces is neither able to see nor get to the pieces that shift to the middle or bottom of the container.

The most common user's solution, and especially a child's solution, to this problem is to dump the pieces out of the container so that they are all visible. This solution, however, creates another drawback when it is time to stop participating in the activity. To clean up, the small play/toy pieces must be picked-up individually, lifted, and put back into the container. If a child or elderly/disabled parent/caregiver is performing this task on small items, the clean-up process may be very difficult. And even for the able-bodied, this clean-up process is slow, tedious, prone to losing pieces, and often frustrating.

For items that are dumped or unpacked from a container to play or work with, parents may provide a separate play or work surface, such as a flat mat, sheet, or blanket. For example, a child may dump play pieces from a backpack onto a flat play mat, which provides cushioning for the pieces and the child, and protects the underlying surface (e.g., a floor or table) from wear. A flat play mat, however, does not restrict the movement or aid clean up of pieces at the end of play, as children typically push and scatter play pieces off of the surface of a play mat while dumping from a container onto a mat, and during play. Thus, even when a flat play mat is used, all pieces that scatter off the mat must typically be picked-up individually, lifted, and put back into a container.

Hence, there is a need for a single, convenient-to-carry, easy-to-store, securely sealable, and easy-to-use device that addresses these drawbacks.

BRIEF DESCRIPTION OF THE DRAWINGS

The accompanying drawings, which are incorporated in and constitute a part of this specification, illustrate embodiments of the invention and together with the description, serve to explain the principles of the invention.

DESCRIPTION OF THE EMBODIMENTS

Generally, embodiments consistent with the present invention include luggage or carrying container devices that open to form a mat or work surface that has a raised lip or edge structure that contains items on the mat or work surface. The luggage or carrying container closes from the mat configuration to convert into a sealed bag or sealed flexible container for holding the items inside, where the seal is formed by the lip or edge structure. Various embodiments provide mats that contain small parts and pieces on a defined surface and also convert to convenient to transport and store containers that securely seal and prevent the same small parts and pieces from falling out when moved.

Reference will now be made in detail to exemplary embodiments of the invention, examples of which are illustrated in the accompanying drawings. Wherever convenient, the same reference numbers will be used throughout the drawings to refer to the same or like parts.

Figure 1:
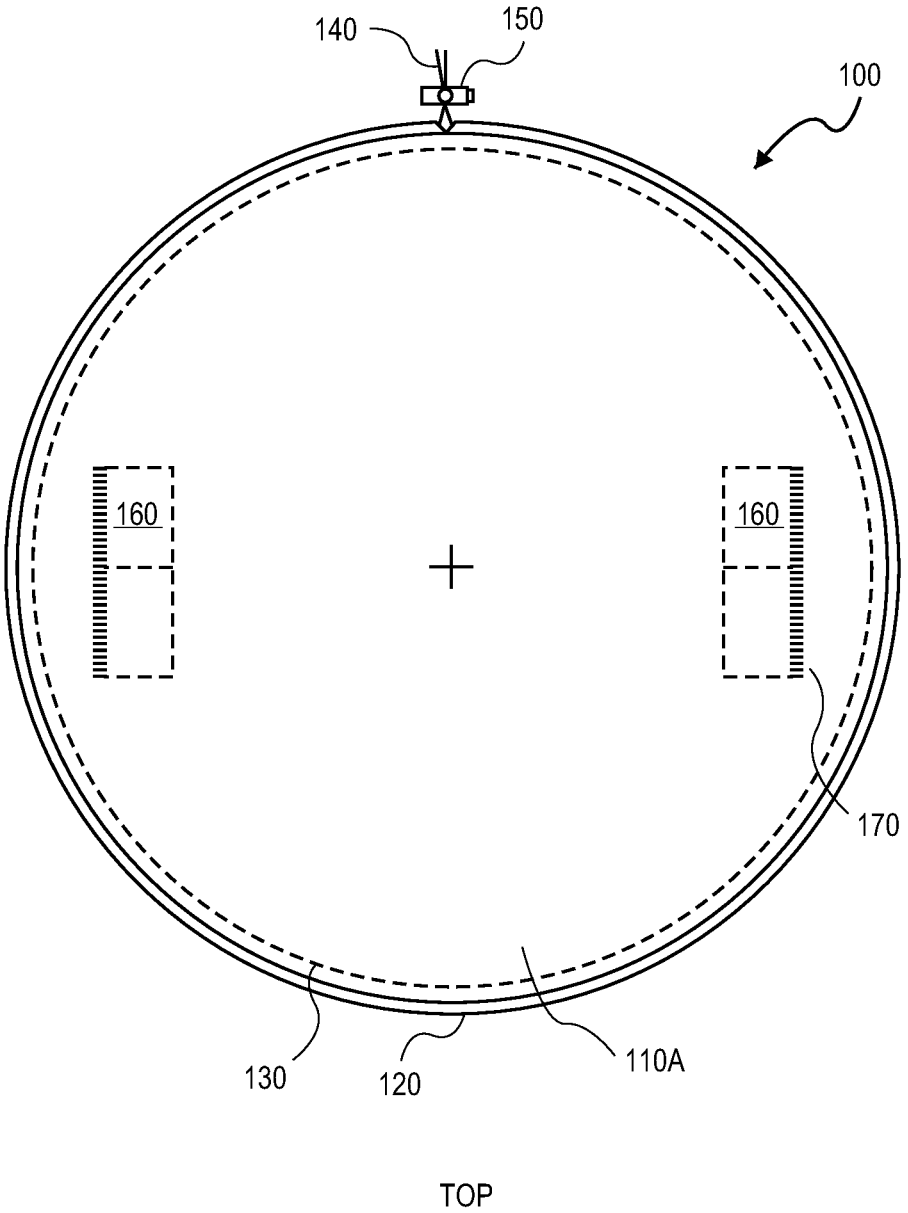
FIG. 1 is a top view of an exemplary convertible containment device in a mat configuration, consistent with embodiments of the invention.

FIG. 1 is a top view of an exemplary convertible containment device 100 in a mat configuration, consistent with embodiments of the invention. In the example shown in FIG. 1, convertible containment device 100 is spread out in a mat or work surface configuration with a top side 110A of a base 110 facing upward. In various embodiments, base 110 may be elliptical, circular (as shown), or oval in shape. In some embodiments, base 110 may be in the shape of a polygon, such as an equilateral, cyclic polygon having six or more sides, e.g., a hexagon, an octagon, etc. Other embodiments of base 110 may be in the shape of a many-sided polygon that approximates an elliptical or oval shape, e.g. a dodecagon, an elongated dodecagon shape, etc. In various embodiments, the diameter or longest dimension of base 110 may be in the range of about 6 inches to about 120 inches or larger, including embodiments of 18 inches and 60 inches.

In some embodiments, base 110 may be formed of one, two or more pieces or layers of flexible material, such as denim, suede, leather, velvet, canvas, cotton twill, large denier polyester, large denier nylon, ballistic nylon, ripstop nylon, nylon mesh fabric, sail oxford ripstop nylon, Cordura™ brand fabric, packcloth, or the like. In some one-piece embodiments, base 110 may be formed of a lightweight flexible material, such as 1.9 oz calendared rip-stop nylon material, microfiber fabric, taffeta fabric, or the like. In some two-piece embodiments, top surface 110A of base 110 may be formed of a lightweight flexible material, such as 1.9 oz calendared rip-stop nylon material, to provide a work or play surface having specific desired qualities, such as being waterproof, stain resistant, pleasant to touch, colorful, easily able to custom print, etc. In such two-piece embodiments, bottom surface 1106 (not shown in FIG. 1) of base 110 may be formed of a relatively heavyweight flexible material, such as 10 oz cotton denim fabric or ballistic nylon. In some embodiments, regardless of the number of layers, base 110 may be formed of multiple materials in sections, such as a ballistic nylon, outer-periphery donut-shaped section, surrounding a nylon mesh "bull's-eye" inner section.

As shown in FIG. 1, a lip 120 is attached to the perimeter of base 110 in a manner that causes at least a portion of lip 120 to stand substantially perpendicular to base 110 when base 110 is spread out on a substantially horizontal surface. Lip 120 forms a wall or barrier around the top surface 110A, and acts to contains any items, parts, or pieces placed on top surface 110A while a user utilizes the items, parts, or pieces. See, for example FIGS. 3 and 4.

In various embodiments, lip 120 stands up substantially perpendicular to base 110 due at least in part to the configuration of lip 120, e.g., its dimensions, such as vertical height above horizontal base 110, and its length in relation to the circumference or peripheral distance around base 110, and its folded form in certain embodiments. In some embodiments, lip 120 stands up substantially perpendicular to base 110 due at least in part to its fabrication from lightweight flexible material, such as 1.9 oz calendared rip-stop nylon material, including its fabrication from a material that is more flexible and lower in weight and density compared to a thicker, more rigid material (e.g., 10 oz. denim) that forms base 110. In some embodiments, lip 120 stands up substantially perpendicular to base 110 due at least in part to its method or implementation of attachment to base 110. In some embodiments, lip 120 stands up substantially perpendicular to base 110 due at least in part to the elliptical, oval, or polygonal shape of base 110. In some embodiments, lip 120 stands up substantially perpendicular to base 110 due at least in part to the presence of a particular length of string or cord inside an envelope formed by lip 120. In some embodiments, lip 120 stands up substantially perpendicular to base 110 due at least in part to a separate stiffening structure such as perpendicular support members attached to the base 110 and situated inside an envelope formed by lip 120.

Figure 5:
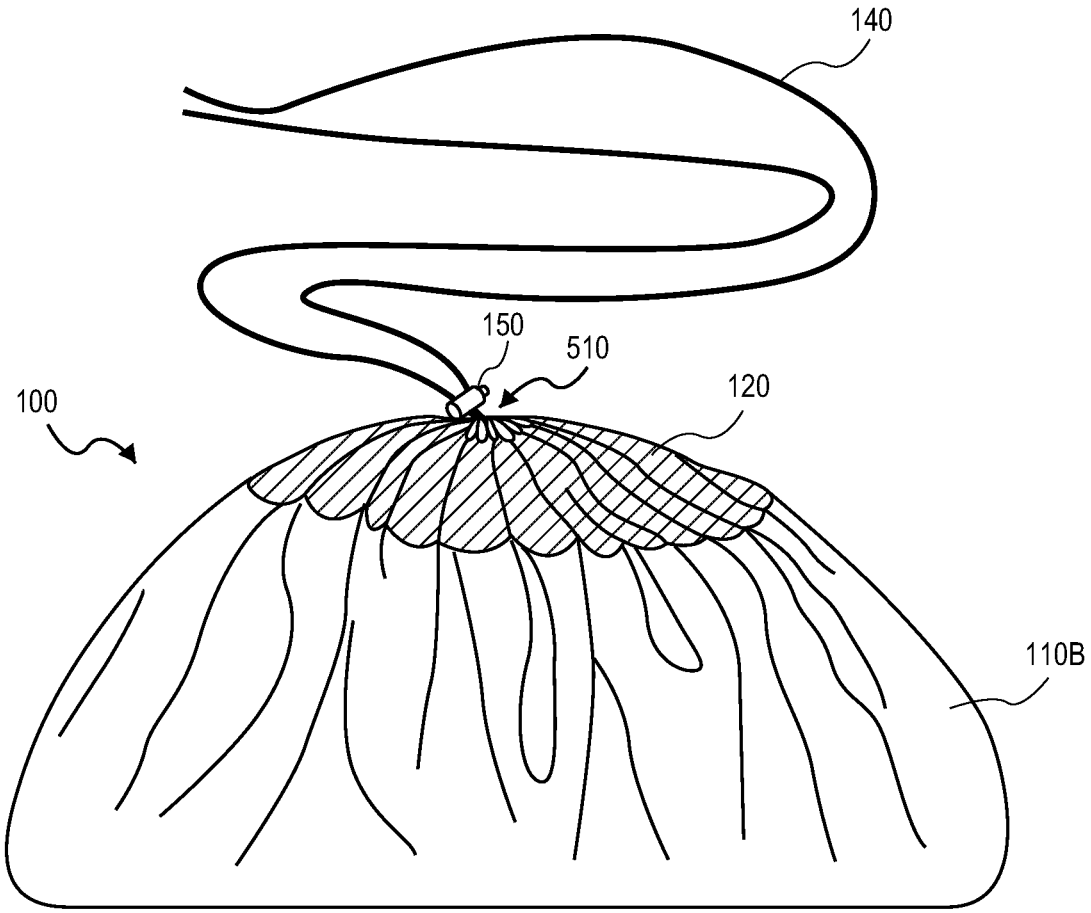
FIG. 5 is a side view of an exemplary convertible containment device in a bag configuration, consistent with embodiments of the invention.

As shown in the exemplary embodiment of FIG. 1, lip 120 may be attached to base 110 by stitches 130. In various embodiments, lip 120 may be configured (e.g., folded over) to form a channel or envelope through which a cinch cord 140 may pass. In various embodiments, cinch cord 140 may be pulled to change convertible containment device 100 from the open flat configuration shown into a closed bag-like configuration (as shown in FIG. 5). In the embodiment shown, cinch cord 140 comes out of adjacent openings of the envelope formed by lip 120 at a single point of the periphery of base 110. As shown in FIG. 1, cinch cord 140 may also pass through a cord lock 150, which may be adjustably employed to clamp and maintain convertible containment device 100 in a closed bag-like configuration. In some embodiments, cinch cord 140 may be constructed of 3 mm or 5 mm climbing cord.

In the embodiment shown in FIG. 1, top surface 110A of base 110 includes interior pockets 160, which may be formed of flexible material, such as various types of fabric, including for example see-through vinyl plastic, that is sewn or otherwise attached to base 110. Interior pockets 160 may be used to contain and separate chosen items from other items contained in convertible containment device 100, especially when convertible containment device 100 is in a bag-like luggage configuration. In the embodiment shown, interior pockets 160 may use zippers 170 to open and close the pocket opening. In other embodiments, buttons, Velcro® brand strips or other closure means may be used to prevent any contents of interior pockets 160 from leaving interior pockets 160. The dimensions, and even the presence, of interior pockets 160 are not critical. As an example, in an embodiment where the diameter of base 110 is about 60 inches, the dimensions of interior pockets 160 may be about 6 inches by about 14 inches.

Figure 2:
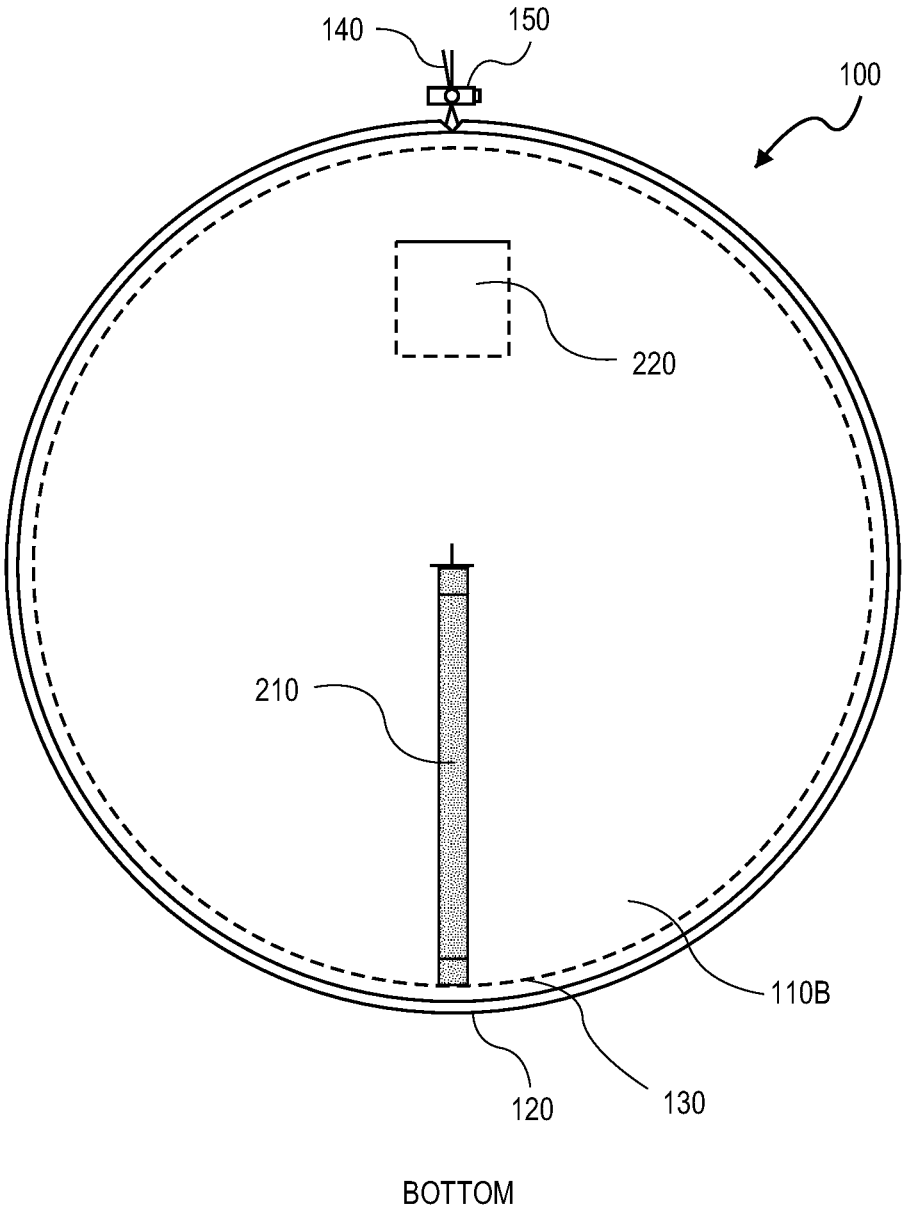
FIG. 2 is a bottom view of an exemplary convertible containment device in a mat configuration, consistent with embodiments of the invention.

FIG. 2 is a bottom view of an exemplary convertible containment device 100 in a mat configuration, consistent with embodiments of the invention. As shown by the bottom view of FIG. 2, base 110 includes a bottom surface 1106. As noted above, in some two-piece embodiments of base 110, bottom surface 1106 of base 110 may be formed of a heavyweight flexible material, such as 10 oz cotton denim fabric or ballistic nylon, while top surface 110A (not shown in FIG. 2) of base 110 may be formed of a flexible material better suited as a work or play surface, including materials that possess waterproof and/or stain resistant properties, such as lightweight nylon materials.

In the embodiment shown in FIG. 2, bottom surface 1106 of base 110 includes a cord pocket 220, which may be formed of flexible material, such as various types of fabric, sewn or otherwise attached to base 110. In various embodiments, cord pocket 220 may include one or more Velcro® brand strips to secure items, in particular the cinch cord 140, inside cord pocket 220. In other embodiments, buttons, snaps, zippers or other closure means may be used to secure cinch cord 140 inside cord pocket 220. The dimensions of cord pocket 220 are not critical, as long as cord pocket 220 can easily store cinch cord 140, which may have a length approximately equal to the circumference or periphery length of base 110.

In the exemplary embodiment shown, cinch cord 140 comes out two openings in the envelope or channel 710 formed by lip 120 (see FIG. 7) at a point of the periphery of base 110 that is near the opening of cord pocket 220. In another embodiment, cinch cord 140 may come out of openings in the envelope or channel 710 formed by lip 120 at two points of the periphery of base 110, such as two points on a diameter of base 110. Such an embodiment may include two cord pockets 220 positioned near the two points on the diameter of base 110 where cinch cord 140 emerges from the envelope of lip 120. In such an embodiment, lip 120 may be formed of two separate pieces, each having a length approximately one-half the circumference of base 110, and cinch cord 140 may include two cord locks 150. Embodiments in which cinch cord 140 comes out of openings in the envelope or channel formed by lip 120 at more than two points of the periphery of base 110 are also possible.

As shown, a carrying strap 210 is also attached to bottom surface 1106. Carrying strap 210 may be formed of strong, flexible material, such as various types of fabric, which are sewn, riveted or otherwise attached to base 110. Carrying strap 210 may be used to lift and carry convertible containment device 100, especially when convertible containment device 100 is in a bag-like luggage configuration. In various embodiments, carrying strap 210 may be constructed of nylon webbing material, and may include a padded section. The dimensions, the attachment points, the number, and even the presence, of carrying strap 210 are not critical. As an example, in an embodiment where the diameter of base 110 is about 60 inches, the length of carrying strap 210 may be about 28 or 29 inches. As another example, in an embodiment where the diameter of base 110 is about 15 inches, a relatively short (e.g., 8 inch or hand sized) carrying strap (see FIG. 4) may be used, having a first attachment point on bottom surface 1106 of base 110 and the other attachment point opposite the first attachment point on top surface 1106 of base 110. As yet another example, two separate carrying straps 210 (not shown) may be provided, configured such that one strap may go over each shoulder of a person, and convertible containment device 100 may be transported as a backpack or knapsack.

Figure 3:
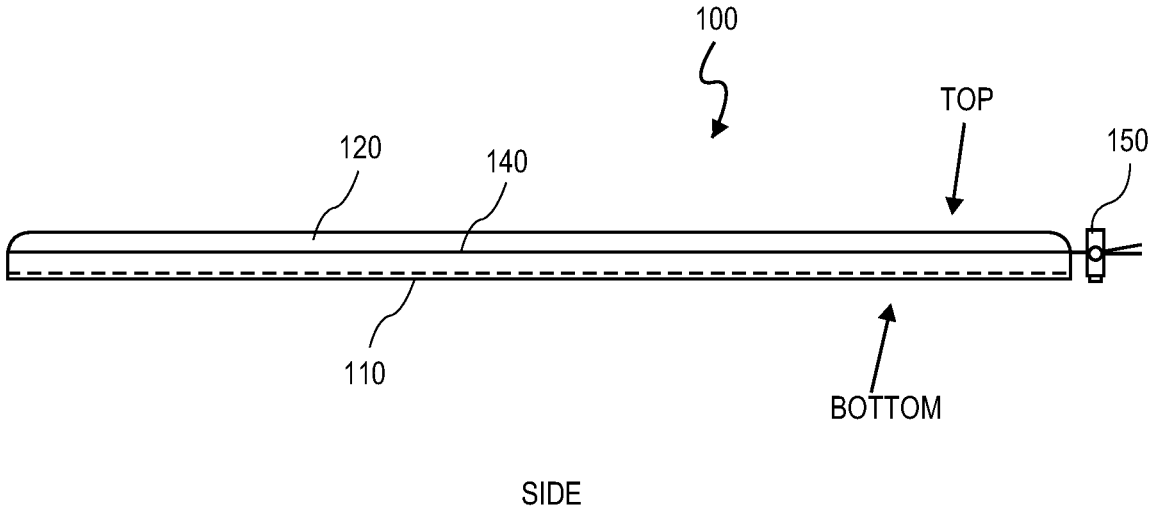
FIG. 3 is a side view of an exemplary convertible containment device in a mat configuration, consistent with embodiments of the invention.

FIG. 3 is a side view of an exemplary convertible containment device 100 in a mat configuration, consistent with embodiments of the invention. In the view shown, base 110 is deployed on a horizontal surface, and lip 120 is standing substantially perpendicular to base 110 and is substantially vertical. In the implementation shown, lip 120 stands at a uniform height throughout its length. In various implementations (not shown), lip 120 may not stand to a uniform height, as portions of lip 120 may flex, sag, or flop over to some degree (e.g., as a function of the flexibility of the material used to form lip 120), reducing the deployed height in localized sections of lip 120.

In FIG. 3, cinch cord 140 is depicted as running inside a cavity or envelope formed by the flexible material of lip 120, up to a point where cinch cord 140 emerges from the cavity, close to where cord lock 150 is deployed in this example.

Figure 4:
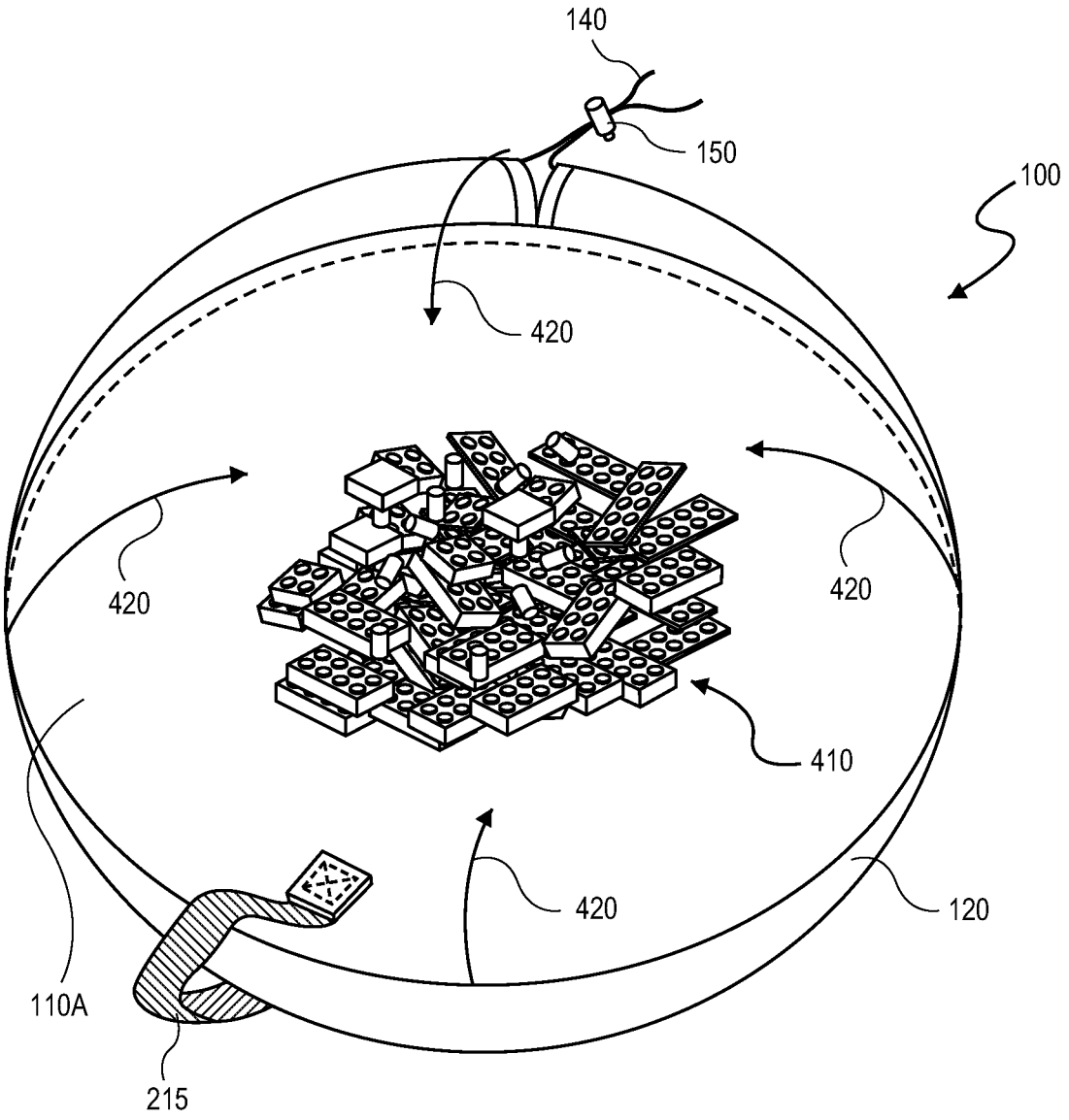
FIG. 4 is a perspective view of an exemplary convertible containment device in a mat configuration, consistent with embodiments of the invention.

FIG. 4 is a perspective view of an exemplary convertible containment device 100 in a mat configuration, consistent with embodiments of the invention. In the view shown, items 410 are contained on the top surface 110A of base 110 by the lip 120 which rises substantially perpendicular to base 110. As noted above, in various embodiments, when deployed in a mat configuration, the height to which lip 120 rises above base 110 may vary at different points around the circumference of base 110, as lip 120 flexes, sags, or flops over. For example, in an embodiment where the maximum height of lip 120 is 3.5 inches, some portions of lip 120 may sag to a height of about 1.5 to 2 inches.

In the embodiment shown, convertible containment device 100 is opened or laid out on a horizontal surface to form a mat or work/play surface having a surrounding containment wall (lip 120). A user may easily spread out items 410, (e.g., various parts; pieces; toys; tools; balls; sporting equipment; knitting equipment; medical tools, supplies, and devices; electronic accessories and devices; cosmetics; travel items; fasteners; camping supplies; military supplies; scuba-diving accessories, emergency survival items, etc.) on the upper surface 110A of base 110, where they can be easily seen and utilized, for example to play or work with as an entire set. As shown, lip 120 stops items 410 from being pushed off of upper surface 110A of base 110 during use of items 410, which later enables a user to quickly and efficiently clean up and store items 410 by converting convertible containment device 100 into the closed, bag-like configuration while items 410 are contained on upper surface 110A of base 110.

Examples of activities involving numerous items 410 include: Lego® brand building blocks, Lincoln Log® brand building sticks, Kynex® brand building blocks, Duplo® brand building blocks, Matchbox® brand toy cars, Hot Wheels® brand toy cars, Polly Pockets® brand figures, American Girl® brand doll sets, Barbie® brand dolls, Squinkies® brand figures, Playmobil® brand figures, wooden building blocks, action figures, Star Wars® brand action figures, Thomas and Friends® brand train toys, Littlest Pet Shop® brand toys, My Little Pony® brand toys, beads, crafts and art supplies, clay modeling, board games, train sets, dolls and doll accessories, stuffed animals, marbles, jacks, puzzles, building sticks, Play-Doh® brand modeling clays, scale model building, electronics construction and repair, mechanical construction and repair, jewelry construction and repair, etc.

Arrows 420 represent the motion of lip 120 when convertible containment device 100 is converted from the mat configuration to the bag configuration. In particular, a user may vertically lift and pull cinch cord 140 while items 410 are on top surface 110A of base 110, such that in the bag configuration top surface 110A becomes part of the inner surface of the bag, while bottom surface 1108 becomes part of the outer surface of the bag. The lifting and pulling of cinch cord 140 causes the lip 120 and the peripheral edge of base 110 to raise and draw together as the portion of cinch cord inside lip 120 becomes smaller, which forms convertible containment device 100 into a bag-like container or piece of luggage with items 410 inside. Once cinch cord 140 is drawn tight to form a bag of convertible containment device 100, the user may deploy cord lock 150 to lock in a position near lip 120, which prevents cinch cord 140 from entering the envelope formed by lip 120 and clamps shut the bag formed by convertible containment device 100.

In various embodiments consistent with the invention, the material that forms the lip 120, (and which envelopes cinch cord 140) may be any material that is flexible, thin, and non-binding to a degree that allows the material to be drawn together in a manner that leaves little or no opening in the bag when the cinch cord 140 is tightened to a large degree—i.e., when cinch cord 140 is used as a draw string to force lip 120 into a smaller annular shape. In one embodiment, 1.9 oz., calendared, rip-stop nylon material provides the appropriate characteristics of flexibility, thinness, and non-bindingness for lip 120. Other materials with similar properties may also be used within the scope of the invention.

The exemplary embodiment shown in FIG. 4 also includes a carrying strap 215, which may be formed of strong, flexible material, such as various types of fabric, and which is sewn, riveted or otherwise attached to base 110. In various embodiments, carrying strap 215 may be constructed of nylon webbing material. The embodiment shown employs carrying strap 215 having a first attachment point (not shown) on bottom surface 1108 of base 110 and a second attachment point opposite the first attachment point on top surface 1108 of base 110. Thus, carrying strap 215 forms a loop and passes through an annular passage (e.g., annular passage 510 of FIG. 5) when convertible containment device 100 is in the bag configuration. The illustrated implementation of carrying strap 215 may be preferable to the implementation of carrying strap 210 (FIG. 2) where the length of carrying strap 210 is shorter than the length required to pass a person's arm through carrying strap 210 and comfortably sling convertible containment device 100 in the bag configuration over the person's shoulder.

FIG. 5 is a side view of an exemplary convertible containment device 100 in a bag configuration, consistent with embodiments of the invention. In the embodiment shown, cinch cord 140 has been drawn to place convertible containment device 100 in a bag or luggage configuration and to essentially close an annular passage 510. In this configuration, bottom surface 1108 of base 110 forms the lower portion of the outside of the bag or luggage. To maintain convertible containment device 100 in the illustrated bag or luggage configuration, a user may slide cord lock 150 to a position adjacent to lip 120 and adjacent to closed annular passage 510 (as shown), and secure cord lock 150 at that position. Locked cord lock 150 prevents any additional length of cinch cord 140 from entering the envelope formed by lip 120 and increasing the diameter or opening size of annular passage 510.

The tightening of cinch cord 140 draws together or gathers together the thin, flexible, non-binding (e.g., slippery) material of lip 120 so that annular passage 510 is essentially closed, at least to a degree that does not allow items 410 to pass through annular passage 510. In various embodiments, a thin, flexible, non-binding material is preferred for lip 120 because such material will gather, compact, and/or fold upon itself inside the loop formed by tightened cinch cord 140 and completely, or nearly completely, fill in and close annular passage 510, thus preventing small items 410 that are inside convertible containment device 100 from escaping from inside the bag configuration shown in FIG. 5.

In one embodiment, 1.9 oz., calendared, rip-stop nylon cloth provides the appropriate characteristics of flexibility, thinness, and non-bindingness for lip 120. Similar suitable materials may include 1.0 ounce nylon cloth; 1.1 ounce silicone impregnated nylon cloth; % ounce nylon spinnaker cloth, 1.1 ounce nylon parachute cloth, paraglider fabric, satin, and the like. Other materials with similar properties may also be used within the scope of the invention. Thicker, heavier materials, such as denim, canvas, large denier nylon, and the like, are not preferred for some embodiments of lip 120 because such materials will not gather, compact, and/or fold upon themselves sufficiently to completely, or nearly completely, close annular passage 510 when cinched into a relatively small annular shape by cinch cord 140.

Figure 6:
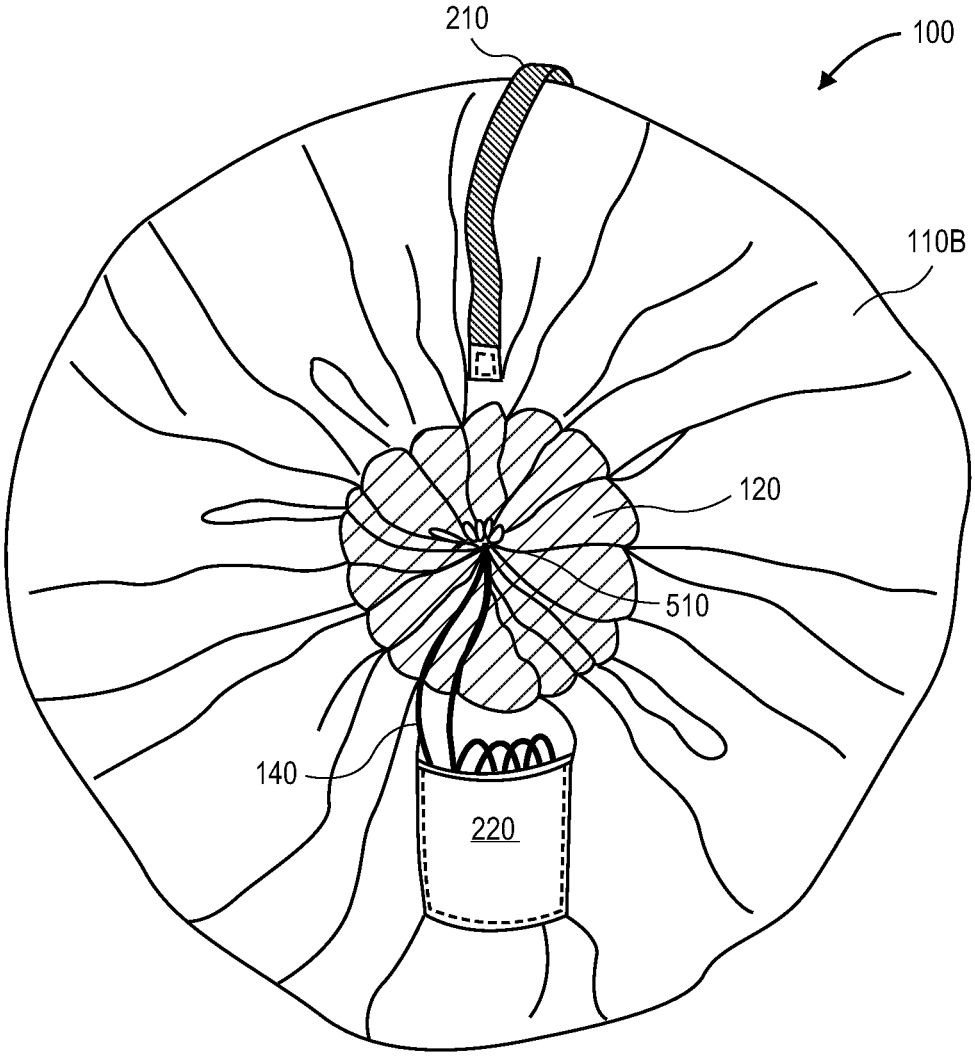
FIG. 6 is a top view of an exemplary convertible containment device in a bag configuration, consistent with embodiments of the invention.

FIG. 6 is a top view of an exemplary convertible containment device 100 in a bag configuration, consistent with embodiments of the invention. As shown, cinch cord 140 has been drawn to place convertible containment device 100 in a bag or luggage configuration and to essentially close annular passage 510. In FIG. 6, cord lock 150 is not shown, for clarity of illustration. Typically, for the closed configuration, cord lock 150 would be positioned adjacent to lip 120 and adjacent to closed annular passage 510, locking annular passage 510 in a drawn-closed position. As shown, the length of cinch cord 140 that was pulled out of the envelope formed by lip 120 to close convertible containment device 100 is stored inside of cord pocket 220. As shown in the view, the tightened cinch cord compresses the material of lip 120 inside annular passage 510 formed by the portion of cinch cord 140 that remains within the passage or envelope 710 formed in lip 120, which blocks and closes annular passage 510. As noted above, in various embodiments, the loose portion of cinch cord 140 may be placed completely inside cord pocket 220, and cord pocket 220 may be fastened closed using a Velcro® brand strip, button, snap, zipper, flap, or other closing means.

The embodiment of FIG. 6, also illustrates that carrying strap 210, which is attached to bottom surface 1106 of base 110, is available for a user to grasp when convertible containment device 100 is in a bag or luggage configuration. A user may, for example, place carrying strap 210 over their shoulder to transport convertible containment device 100, with items 410 inside, to another location.

Figure 7:
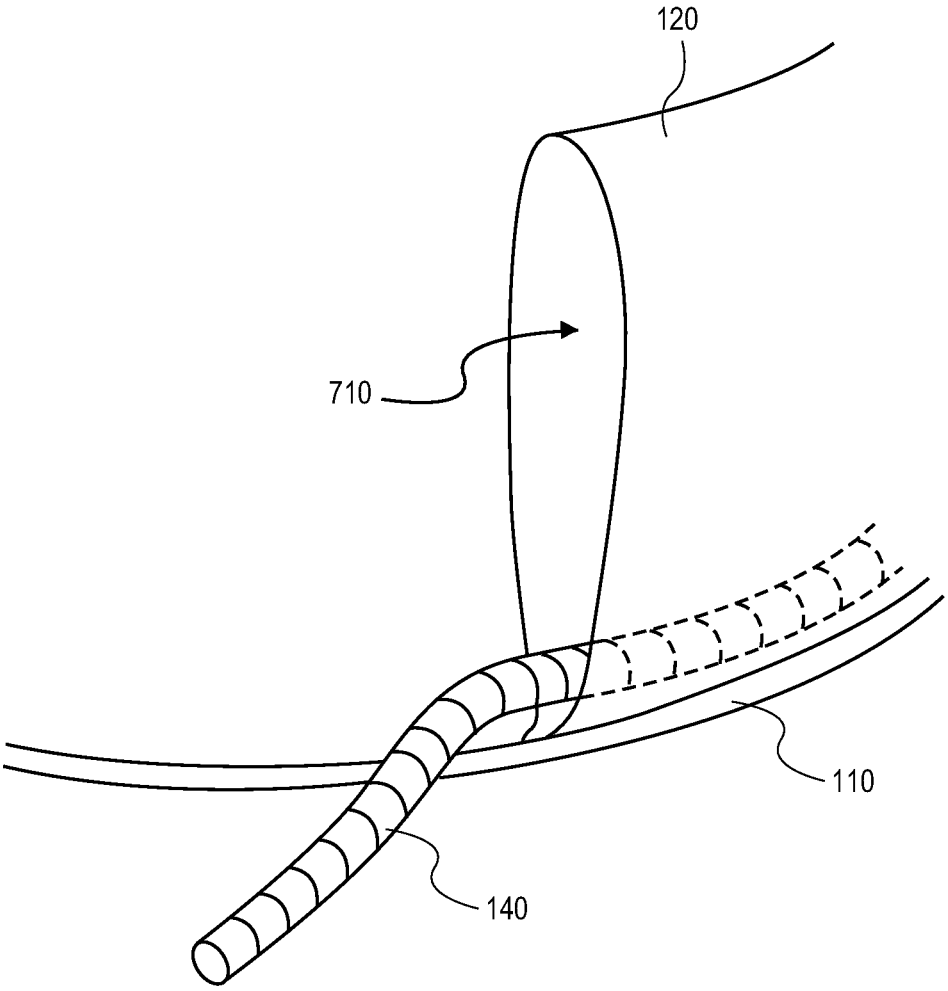
FIG. 7 is a detailed perspective view of an exemplary containment lip and drawstring of a convertible containment device, consistent with embodiments of the invention.

FIG. 7 is a detailed perspective view of an exemplary containment lip 120 and drawstring 140 of a convertible containment device 100, consistent with embodiments of the invention. As shown, lip 120 may be made of a flexible material that is doubled over or folded over and attached to base 110 in a manner that forms a hollow cavity, channel or envelope 710, having openings at each end. In various embodiments, cinch cord 140 may be run through envelope 710, so that cinch cord 140 surrounds base 110 when convertible containment device 100 is open and laid out in the mat configuration, and so that cinch cord 140 may be drawn or slid through and out of openings in envelope 710 to form a bag with an annular passage 510.

In some embodiments (not shown), envelope 710 may be divided into two or more smaller envelopes, for example by stitching or otherwise lengthwise joining together the walls of envelope 710. In such embodiments, cinch cord 140 may pass through one of the smaller envelopes. For example, in the case where envelope 710 is divided into two smaller envelopes, cinch cord 140 may pass through the lower small envelope, which is adjacent to base 110, in order to enhance the standing up of lip 120 when convertible containment device 100 is in the mat configuration. For another example, in the case where envelope 710 is divided into three smaller envelopes, cinch cord 140 may pass through the middle small envelope, which is removed from base 110 by a lower envelope, in order to enhance the cinching and closing of annular passage 510 when convertible containment device 100 is in the bag or luggage configuration.

In other embodiments (not shown), envelope 710 may be empty, or envelope 710 may be nonexistent for embodiments where the material forming lip 120 is not folded over. In such embodiments, cinch cord 140 may be attached to the outside of lip 120 using loops (e.g., similar to belt loops) or other means of slidable attachment that allows lip 120 to be cinched closed in the bag configuration. In still other embodiments, cinch cord 140 may be replaced by another closing mechanism, such as a clamp (e.g., similar to one half of a pair of handcuffs, similar to a tightening or ratcheting strap as found on a ski boot, or similar to a locking wood clamp, and the like) that is clamped on the outside of, and squeezes together, the folds of lip 120 after a user has gathered the folds together by hand to form a bag configuration. In such embodiments, the clamp may be stored in outside pocket 220 when convertible containment device 100 is in the mat configuration.

Figure 8:
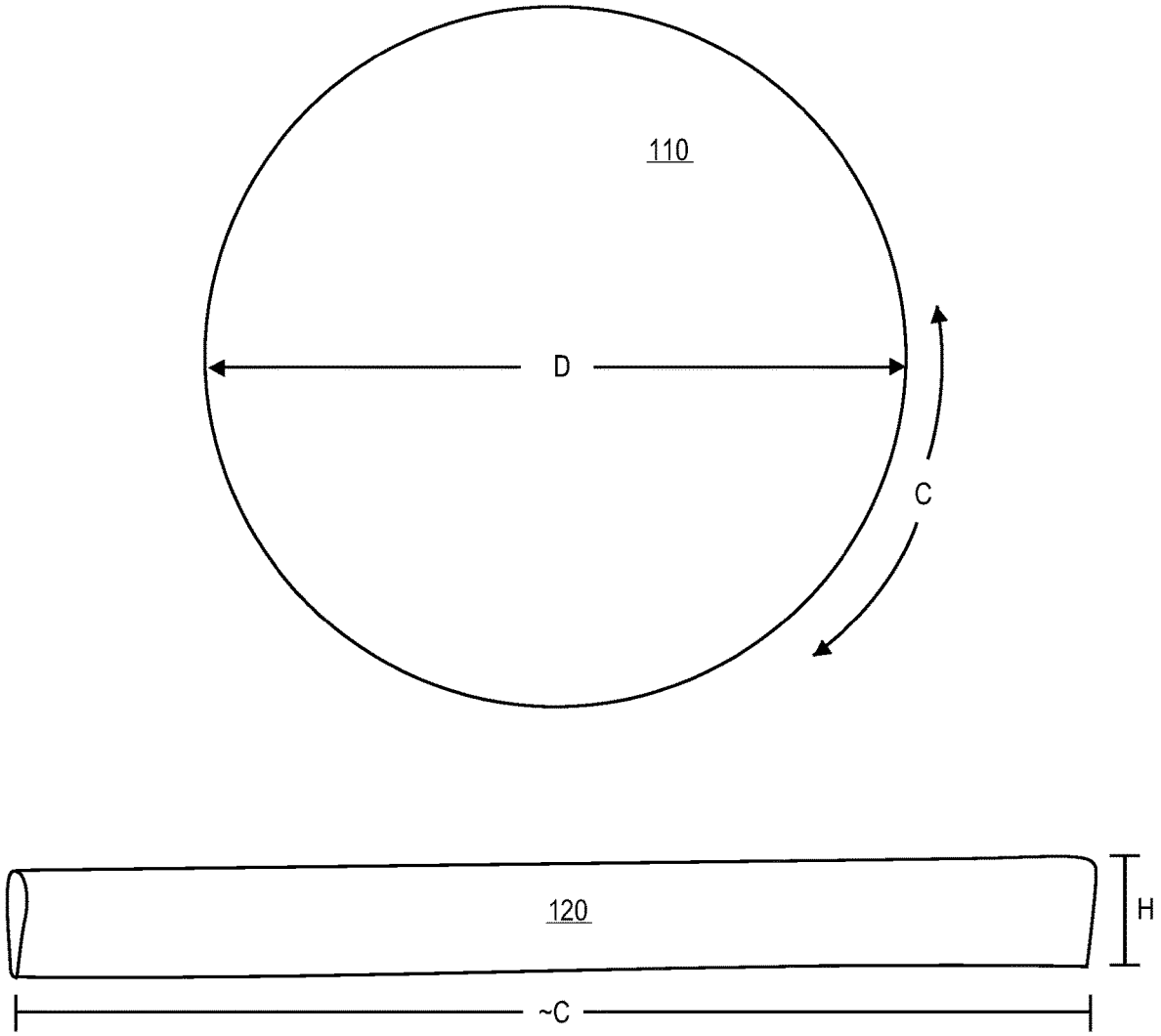
FIG. 8 is a view of exemplary components of a convertible containment device, consistent with embodiments of the invention.

FIG. 8 is a view of exemplary components of a convertible containment device, consistent with embodiments of the invention. In the example shown, base 110 has a circular shape with a diameter D and a circumference C. In various embodiments, the diameter of base 110 may be in the range of about 6 inches to about 120 inches or larger, including embodiments of 18 inches and 60 inches. The circumference C for a given diameter D may be calculated using the well-known formula $C=\pi D$.

In the example shown, lip 120 has a folded-over rectangular shape with a length approximately equal to the circumference C of base 110. In various embodiment, the length of lip 120 may be a longer or shorter than C. In some embodiments, variations from length C may be needed to facilitate attaching lip 120 along the periphery of base 110, among other things. As shown, lip 120 also has a height dimension H. In various embodiments, the height of lip 120 may be in the range of about 1 inch to about 5 inches or larger, including embodiments of 1.5 inches and 3.5 inches.

In some embodiments, making the length of lip 120 approximately equal to C, and/or attaching lip 120 to base 110 so that the effective length of lip 120, without counting overlap, is approximately equal to C, creates a structure that urges lip 120 to rise or stand up in a vertical direction when base 120 is spread out flat on a horizontal surface, such as a floor or table. In some embodiments, lip 120 may be made of more than one piece, each piece having a length that together making the overall length of lip 120 approximately equal to C. Such embodiments may have multiple openings in the envelope 710, from which a cinch cord 140 may emerge. In some embodiments, the length of lip 120 may be slightly greater than C, for example from about one-half inch to about one inch greater than C, such that the ends of lip 120 overlap to some degree when attached to base 110, reducing or eliminating space(s) between the ends of lip 120 when attached to base 110.

Although the embodiment of FIG. 8 is described using circular base 110 as an example, corresponding principles apply when base 110 is shaped as an ellipse, oval, polygon, or the like.

Figure 9:
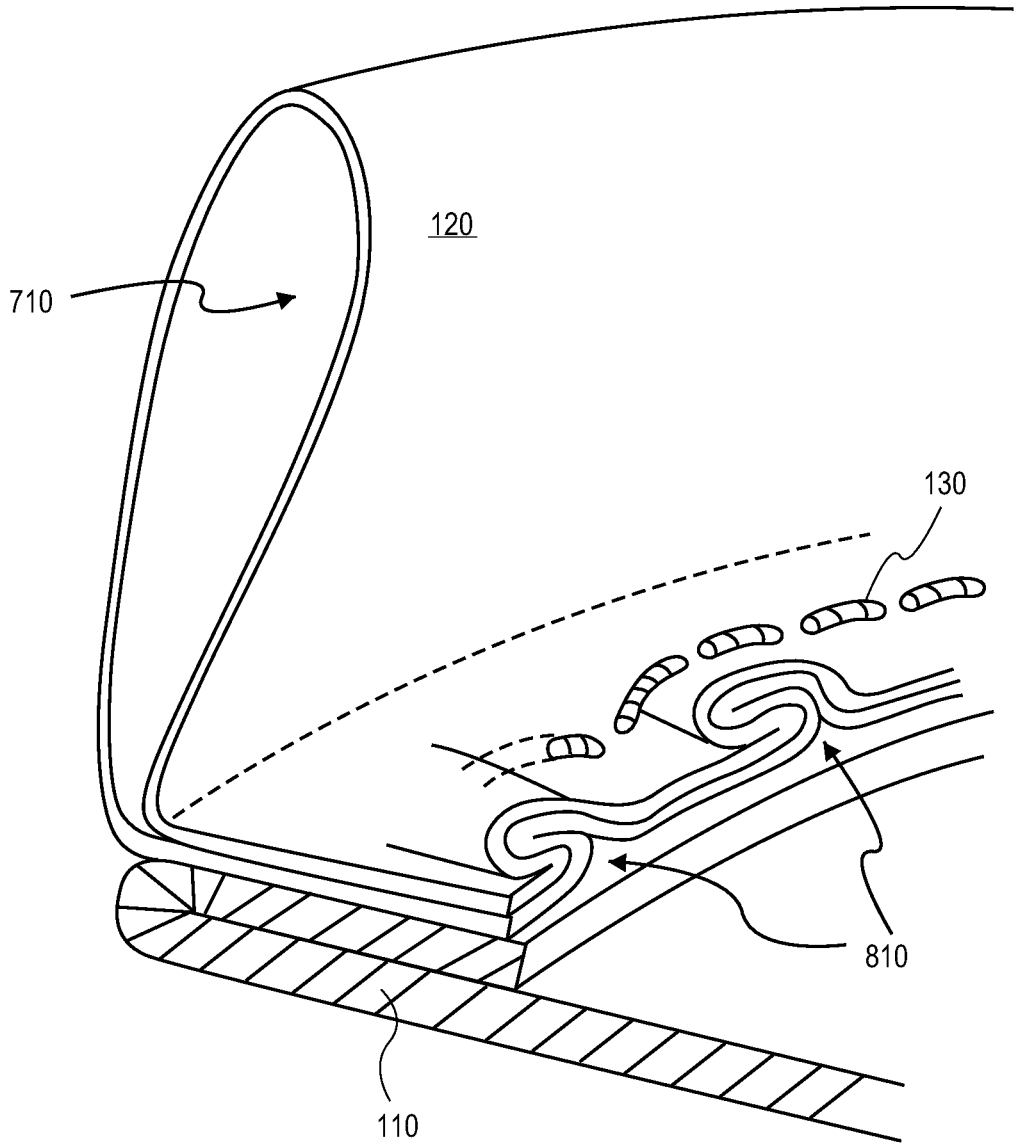
FIG. 9 is a detailed perspective view of an exemplary attachment between a containment lip and a base of a convertible containment device, consistent with embodiments of the invention.

FIG. 9 is a detailed cut-away perspective view of an exemplary attachment between a containment lip 120 and a base 110 of a convertible containment device 100, consistent with embodiments of the invention. In the example shown, lip 120 is attached to base 110 using gathers or pleats 810 secured by stitches 130. In this embodiment, pleats 810 allow the straight edge of lip 120 to be attached to the curved or multi-angled periphery of base 110, and provide structure and static forces which urge lip 120 to rise or stand approximately perpendicular to base 110.

In the embodiment shown, base 110 is folded over at the periphery to provide a more substantial anchor for stitches 130. In other embodiments, base 110 may not include this fold. In the embodiment shown, base 110 is formed of a single piece of material. In other embodiments, base 110 may be formed of multiple pieces. In some of these embodiments a second layer of base material may be placed over pleats 810 before stitching, such that pleats 810 are sandwiched between two base pieces. In yet other embodiments, a similar sandwiching arrangement that includes a third piece of padding may be used to form base 110.

Attachment means other than stitches 130, such as glue, heat welding, rivets, etc. are within the scope of the invention. In some embodiments, serge stitching or overlocking stitching may be used to attach lip 120 to base 110.

In some embodiments, base 110 and lip 120 may be formed of a single piece of thin flexible material (not shown). In such embodiments, the folded over edge of the single piece may be formed into pleats or gathers, similar to pleats 810, so as to urge the portion of the single piece forming the envelope to rise approximately perpendicular to the portion of the single piece forming the base.

Although the example illustrated in FIG. 9 shows pleats 810 as gathering enough material of lip 120 to fold over, in other implementations pleats 810 may gather in a lesser amount of material that is insufficient to fold over as shown, but which instead forms a smaller single fold in a substantially perpendicular orientation to base 110. This single-fold implementation may be more desirable in embodiments where base 110 has a diameter of about three feet or larger. Other implementations are possible within the scope of the invention.

Figure 10:
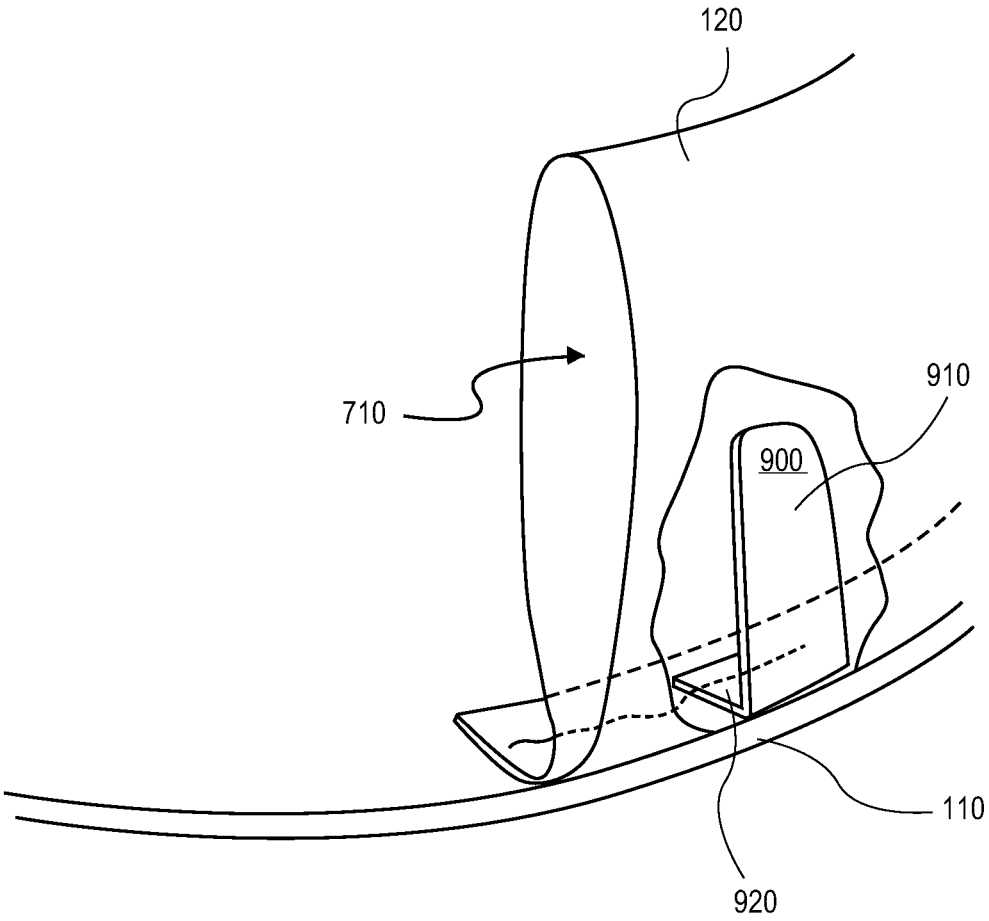
FIG. 10 is a detailed perspective view of an exemplary containment lip with support member of a convertible containment device, consistent with embodiments of the invention.

FIG. 10 is a detailed cut away perspective view of an exemplary containment lip 120 with a support member 900 for a convertible containment device 100, consistent with embodiments of the invention. In the embodiment shown, envelope 710 formed by lip 120 contains a support member 900 that cause at least a portion of lip 120 to stand up from or rise approximately perpendicular to base 110. As shown, support member 900 may be "L" shaped, with a first leg 920 of support member 900 sewn or otherwise attached to base 110 such that a second leg 910 of support member 900 stands substantially perpendicular to the base 110, holding up at least a portion of lip 120. In some embodiments, the length of the second leg 910 may be approximately half the height of lip 120, or shorter, to avoid interfering with the gathering of the top edge of lip 120 when cinch cord 140 (not shown) is tightened to close convertible containment device 100 into a bag configuration.

In some embodiments, support member 900 may be formed of a somewhat stiff yet pliable material, such as vinyl plastic or the like. In other embodiments, support member 900 may be formed of other materials that provide structure to cause lip 120 to stand up, such as wire, sections of thick fabric (e.g., ballistic nylon), leather, and the like.

In various embodiments, several support members 900 may be placed within envelope 710 at spaced intervals (not shown) around the periphery of base 110. For example, support members 900 may be spaced from about 6 inches to about 18 inches apart around the periphery of base 110. In some embodiments, the distance between support members 900 may be at least 8 inches to avoid interfering with the gathering of lip 120 when cinch cord 140 (not shown) is tightened to close convertible containment device 100 into a bag configuration.

One advantage, among several, of the disclosed convertible containment device is that various embodiments provide an easily storable and transportable shoulder satchel, bag, or knapsack that converts into a mat and that is structured to securely contain large and small items both in the open, mat position and in the closed bag/satchel/knapsack position. Various embodiments allow users, including children of appropriate age, to quickly and efficiently clean up pieces, parts, components, etc. that are laid out and/or used on the open mat.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A convertible containment device, comprising:

a flexible base having a perimeter;

a wall affixed to the perimeter of the flexible base and extending substantially perpendicular above a horizontal supporting surface when the device is in an open configuration on the horizontal supporting surface; and a cinch cord running within the wall, and forming a loop when the device is in the open configuration, wherein the cinch cord is configured such that pulling the cinch cord causes the device to transform from the open configuration to a bag-like configuration by gathering the wall to form an annular opening, and wherein the annular opening is nearly completely closed by the cinch cord in the bag-like configuration.

2. The convertible device of claim 1, wherein a length of the wall is approximately equal to a length of the perimeter of the base.

3. The convertible device of claim 1, wherein the wall is affixed to the perimeter of the flexible base using stitches.

4. The convertible device of claim 1, wherein the annular opening is completely closed in the bag-like configuration.

5. The convertible device of claim 1, wherein a shape of the flexible base in the open configuration is selected from one of an ellipse and a polygon.

6. The convertible device of claim 5, wherein the polygon is selected from one of a hexagon, an octagon, and a dodecagon.

7. The convertible device of claim 1, wherein the flexible base comprises two layers of flexible material.

8. The convertible device of claim 7, wherein at least one of the two layers is waterproof.

9. The convertible device of claim 1, wherein the wall is divided lengthwise by stitching to form two envelopes; and wherein the cinch cord runs within one of the two envelopes.

10. The convertible device of claim 9, wherein the cinch cord runs through the one of the two envelopes that is adjacent to the flexible base.

11. The convertible device of claim 1, comprising an interior pocket that is attached to the flexible base, and exposed in the open configuration.

12. The convertible device of claim 1, wherein most of the flexible base lays flat on the horizontal supporting surface when the device is in the open configuration.

13. The convertible device of claim 1, wherein the cinch cord has a length; and wherein the wall extends substantially perpendicular above the horizontal supporting surface due at least in part to the length of the cinch cord.

14. A convertible containment device, comprising:

base means for supporting an item placed thereon and having an outer perimeter and configured to lay substantially flat on a horizontal supporting surface when in an open configuration;

wall means affixed to the outer perimeter for restricting the item from leaving the base means when the base means is in the open configuration, and extending substantially perpendicularly relative to the horizontal supporting surface in the open configuration; and tightening means for causing the wall means to gather upon itself and draw the wall means into an annulus that is nearly completely closed to form a bag-like configuration of the convertible containment device.

15. The convertible containment device of claim 14, wherein the base means comprises two layers, and wherein at least one of the two layers is waterproof.

16. The convertible containment device of claim 14, wherein the wall means comprises material having greater flexibility than material comprising the base means.

17. The convertible containment device of claim 14, wherein most of the base means lays flat on the horizontal supporting surface when the device is in the open configuration.

18. The convertible containment device of claim 14, wherein the wall means comprises two length-wise envelopes; and wherein the tightening means passes through one of the two length-wise envelopes.

19. The convertible containment device of claim 14, wherein the tightening means has a length; and wherein the wall means extends substantially perpendicularly relative to the horizontal supporting surface due at least in part to the length of the cinch cord.

20. The convertible containment device of claim 14, wherein a shape of the base means is selected from one of an ellipse and a polygon.

21. A convertible containment device, comprising:

a flexible base configured to substantially conform to a horizontal supporting surface when the device is in an open configuration;

a wall affixed to a perimeter of the flexible base, wherein the wall is configured to extend substantially perpendicular to the horizontal supporting surface when the device is in the open configuration; and a cinch cord passing through an envelope formed within the wall and looping near the perimeter of the flexible base, wherein the cinch cord is configured such that pulling the cinch cord causes the wall to gather and to draw the wall toward itself to form an annulus that is nearly completely closed.

* * * * *